United States Patent [19]

Dang et al.

[11] Patent Number: 4,654,136

[45] Date of Patent: Mar. 31, 1987

[54] MONOPOLAR OR BIPOLAR ELECTROCHEMICAL TERMINAL UNIT HAVING A NOVEL ELECTRIC CURRENT TRANSMISSION ELEMENT

[75] Inventors: Hiep D. Dang, Lake Jackson; Richard N. Beaver, Angleton; John R. Pimlott, Sweeny, all of Tex.

[73] Assignee: The Dow Chemical Company, Midland, Mich.

[21] Appl. No.: 682,886

[22] Filed: Dec. 17, 1984

[51] Int. Cl.[4] ..... C25B 9/04

[52] U.S. Cl. ..... 204/283; 204/252; 204/254; 204/290 R; 204/279

[58] Field of Search ..... 204/252–254, 204/256, 258, 270, 277, 279, 280, 282–284, 290 R, 292

[56] References Cited

U.S. PATENT DOCUMENTS

| | | | |
|---|---|---|---|
| 4,056,458 | 11/1977 | Pohto et al. | 204/263 |
| 4,191,618 | 3/1980 | Coker et al. | 204/98 |
| 4,214,969 | 7/1980 | Lawrance | 204/279 |
| 4,224,121 | 9/1980 | Dempsey et al. | 204/98 |
| 4,247,376 | 1/1981 | Dempsey et al. | 204/128 |
| 4,294,671 | 10/1981 | Balko | 204/128 |
| 4,340,452 | 7/1982 | de Nora | 204/129 |
| 4,343,689 | 8/1982 | de Nora et al. | 204/253 |
| 4,343,690 | 8/1982 | de Nora | 204/263 |
| 4,444,632 | 4/1984 | de Nora | 204/98 |
| 4,444,639 | 4/1984 | Schurig et al. | 204/257 |
| 4,444,641 | 4/1984 | Oda et al. | 204/286 |
| 4,448,662 | 5/1984 | DuBois et al. | 204/252 |
| 4,457,815 | 7/1984 | Levin | 204/98 |
| 4,457,822 | 7/1984 | Asano et al. | 204/252 |
| 4,457,823 | 7/1984 | LaConti et al. | 204/282 |
| 4,464,242 | 8/1984 | Boulton | 204/253 |
| 4,464,243 | 8/1984 | Woolhouse | 204/257 |
| 4,468,311 | 8/1984 | de Nora et al. | 204/252 |
| 4,488,946 | 12/1984 | Morris et al. | 204/286 |

*Primary Examiner*—Terryence Chapman

*Attorney, Agent, or Firm*—James H. Dickerson, Jr.

[57] ABSTRACT

The invention is an electrochemical terminal unit suitable for use in monopolar or bipolar electrochemical cells comprising:

an electric current transmission element in the form of a substantially planar, continuous electrically conductive body having a plurality of bosses on at least one face of electric current transmission element;

a metal liner having a profile matching the face of the electric current transmission element having the plurality of bosses;

wherein said metal liner is made from a corrosion resistant metal and disposed over the opposite surfaces of said electric current transmission element;

foraminous electrode components disposed over said liner and resting over said raised portions, said electrode components and said metal liner being connected together at least a portion of said bosses; and an electrical connection means for connecting a pole of an electric current power supply on at least one of the edges of said electric current transmission element.

31 Claims, 4 Drawing Figures

MONOPOLAR OR BIPOLAR ELECTROCHEMICAL TERMINAL UNIT HAVING A NOVEL ELECTRIC CURRENT TRANSMISSION ELEMENT

The present invention relates to an improved monopolar or bipolar electrochemical terminal unit design and generally to a chlor-alkali monopolar electrode terminal unit having an inexpensive, simple, efficient means for transmitting electrical current to or from the electrode components thereof.

BACKGROUND OF THE INVENTION

Chlorine and caustic are essential and large volume commodities which are basic chemicals required in all industrial societies. They are produced almost entirely electrolytically from aqueous solutions of an alkali metal chloride with a major portion of such production coming from diaphragm type electrolytic cells. In the diaphragm electrolytic cell process, brine (sodium chloride solution) is fed continuously to the anode compartment and flows through a diaphragm usually made of asbestos, backed by a cathode. To minimize back migration of the hydroxide ions, the flow rate is always maintained in excess of the conversion rate so that the resulting catholyte solution has unused alkali metal chloride present. Hydrogen ions are discharged from the solution at the cathode in the form of hydrogen gas. The catholyte solution, containing caustic soda (sodium hydroxide), unreacted sodium chloride and other impurities, must then be concentrated and purified to obtain a marketable sodium hydroxide commodity and sodium chloride which can be reused in the chlorine and caustic electrolytic cell for further production of sodium hydroxide.

With the advent of technological advances such as the dimensionally stable anode and various coating compostions therefor which permit ever narrowing gaps between the electrodes, the electrolytic cell has become more efficient in that the current efficiency is greatly enhanced by the use of these electrodes. Also, the hydraulically impermeable membrane has added a great deal to the use of electrolytic cells in terms of the selective migration of various ions across the membrane so as to exclude contaminants from the resultant products thereby eliminating some costly purification and concentration steps of processing.

The dimensionally stable anode is today being used by a large number of chlorine and caustic producers but the extensive commercial use of hydraulically impermeable membranes has yet to be realized. This is at least in part due to the fact that a good, economical electrolytic cell structure for use of the planar membrane versus the three dimensional diaphragm has yet to be provided. The geometry of the diaphragm electrolytic cell's structure makes it undesirable to place a planar membrane between the electrodes, hence the filter press electrolytic cell structure has been proposed as an alternative electrolytic cell structure for the use of membrane in the production of chlorine, alkali metal hydroxides and hydrogen.

There are two basic types of electrochemical cells commonly used for the electrolysis of brine solutions to form chlorine and caustic, i.e., monopolar cells and bipolar cells.

A bipolar filter press electrolytic cell is a cell consisting of several electrochemical units in series, as in a filter press, in which each unit, except the two end units, acts as an anode on one side and a cathode on the other, with the space between these bipolar units being divided into an anode and a cathode compartment by a membrane. In a typical operation, an alkali metal halide solution is fed into the anode compartment where halogen gas is generated at the anode. Alkali metal ions are selectively transported through the membrane into the cathode compartment and associate with hydroxide ions at the cathode to form alkali metal hydroxides, as hydrogen is liberated. In this type of cell the resultant alkali metal hydroxide is significantly purer and can be more concentrated, thus minimizing an expensive evaporation and salt separation step of processing. Cells where the bipolar electrodes and membranes are sandwiched into a filter press type construction are electrically connected in series, with the anode of one, connected to the cathode of an adjoining cell through a common structural member of some sort.

Monopolar, filter press, electrolytic units are known comprising terminal cells and a plurality of cathode units and anode units positioned alternately between the terminal cells.

A separator, which may be a diaphragm, or an ion exchange membrane, is positioned between each adjacent anode and cathode to divide the cell into a plurality of anode and cathode units. Each of the anode units is equipped with an inlet through which electrolyte may be fed to the unit and an outlet or outlets through which liquids and gases may be removed from the unit. Each cathode unit is similarly equipped with an outlet or outlets and if necessary with an inlet through which liquid, e.g. water, may be fed to the cathode units. Each of the anodes in the cell is also equipped with connections through which electrical current may be fed to the cell and each of the cathodes is equipped with connections through which electrical current may flow away from the cell.

In monopolar cells, electrical current is fed to one electrode unit and removed from an adjacent, oppositely charged unit. The current does not flow through a series of electrodes from one end of a series of cells to the other end of the series, as in a bipolar cell assembly.

To assure the effective use of substantially all of the surface of the electrodes in a monopolar cell, it is desirable to provide electrical current to the electrode relatively evenly and without excessive resistance losses. To accomplish this, workers in the prior art have devised a variety of mechanisms and designs by which electrical current may be efficiently delivered to the electrode.

The first, and most obvious means to provide electrical current to a monopolar cell is by directly connecting the power supply to the electrode using a wire, cable, rod, etc. Although this design minimizes the resistance losses in the electrical distribution system, it does not work well because some electrodes are not sufficiently electrically conductive to distribute the electrical current relatively uniformly throughout the entire electrode body. This is particularly true for titanium electrodes, which are frequently used in chlor-alkali cells. Thus, it is frequently necessary to provide a plurality of connections to the electrode to assure proper current distribution.

U.S. Pat. No. 4,464,242, for example, provides a thin, rectangular sheet electrode structure having electrical connections all across one, long edge. The electrode structure is sufficiently electrically conductive to distribute the electrical current through a narrow width of the electrode but not sufficiently conductive to distribute electrical current through the length of the electrode. Obviously, this electrical distribution means, works only for narrow electrodes and is not suitable for larger electrodes. In addition, the system is cumbersome and expensive because so many electrical connections are involved.

In a similar manner, U.S. Pat. No. 4,464,243 shows a cell where a plurality of electrode strips are electrically connected at their ends to an electrically conductive hollow frame. Since some electrodes are not very electrically conductive, the height of the electrodes is limited and such a system is limited to shorter electrodes. Also, this means of electrical attachment involves a plurality of electrical connections, each of which is an actual or potential electrical discontinuity. U.S. Pat. No. 4,464,243 also shows electrode sheets having ridges wherein the sheet acts as the conductor.

An alternate means for distributing electrical current to monopolar electrodes is illustrated in U.S. Pat. No. 4,056,458 where a plurality of titanium coated copper rods extend vertically between a pair of parallel, planar electrodes. The rods are electrically connected to both of the electrodes and provide electrical energy thereto. Because the rods are positioned at frequent intervals, the electrical current does not have very far to travel through the electrodes and the overall dimensions of the electrodes may be increased, so long as the number of rods is correspondingly increased. This means of electrical connection is, however, not entirely satisfactory because of its expense and complexity. In addition, there are a large number of actual or potential electrical discontinuity sites.

An electrical distribution means for monopolar electrochemical cells having a minimum number of parts, a minimum number of electrical connections, employing inexpensive, readily-available materials and allowing the use of electrodes of virtually any reasonable length and width would be highly desirable. It is the object of this invention to provide such a means.

SUMMARY OF THE INVENTION

The invention is an electrochemical terminal unit suitable for use in monopolar or bipolar electrochemical cells comprising:

an electric current transmission element in the form of a substantially planar, continuous electrically conductive body having a plurality of bosses on at least one face of electric current transmission element;

a metal liner having a profile matching the face of the electric current transmission element having the plurality of bosses;

wherein said metal liner is made from a corrosion resistant metal and disposed over the opposite surfaces of said electric current transmission element;

foraminous electrode components disposed over said liner and resting over said raised portions, said electrode components and said metal liner being connected together at least a portion of said bosses; and an electrical connection means for connecting a pole of an electric current power supply on at least one of the edges of said electric current transmission element.

BRIEF DESCRIPTION OF THE DRAWINGS

The invention can be better understood by reference to the drawings illustrating the invention, and wherein like reference numerals refer to like parts in the different drawing figures, and wherein.

DETAILED DESCRIPTION OF THE PREFERRED EMBODIMENT OF THE INVENTION

Figure 1:
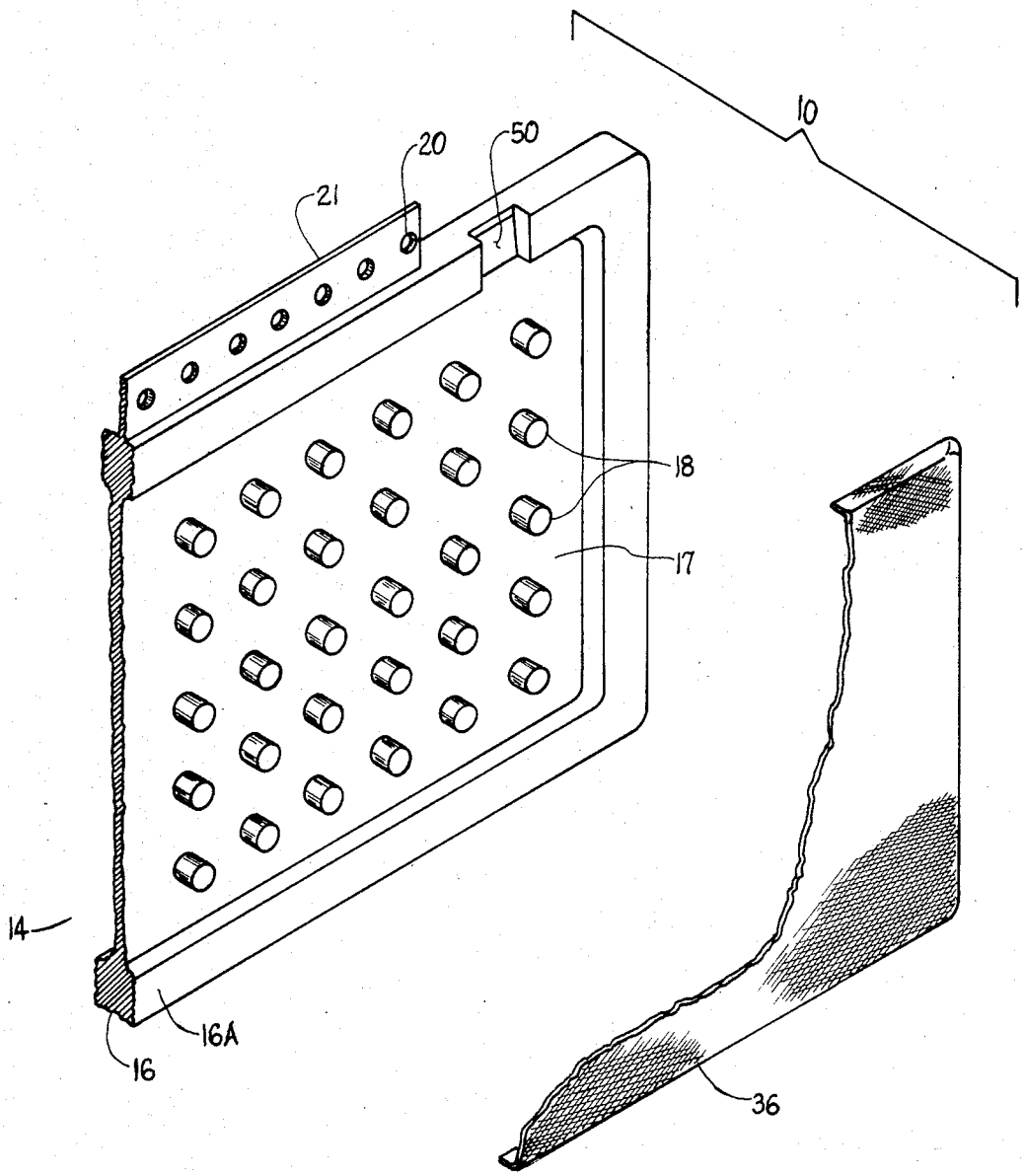
FIG. 1 is an exploded, partially broken-away perspective view of the terminal unit 10.

The present invention is a monopolar or bipolar electrochemical terminal unit assembly having an electric current transmission element which efficiently and evenly provides electrical current to the electrode components of the cell. The invention is particularly suitable for use as a terminal unit in a chlor-alkali electrochemical cell series. As such, it is a simple, inexpensive, easily manufactured terminal unit highly suitable for commercial use.

To fully understand the present invention, it is helpful to understand the concept of resistivity and how resistivity affects the ability of a material to transport electrical energy.

"Resistivity" is the direct current (d.c.) resistance between the opposite parallel faces of a portion of the material having a unit length and a unit cross section. The resistivity of a material determines the electrical resistance offered by a material. Resistance is calculated according to the formula:

$$R = \rho \frac{L}{A}$$

where

R=resistance, microohms $\rho$=resistivity, microohm-cm

L=length, cm

A=cross sectional area, $cm^2$

*Marks' Standard Handbook for Mechanical Engineers Seventh Edition,* edited by Theodore Baumeister, McGraw-Hill Book Company, New York (1967) lists the resistivity of a variety of metals:

| Metal | Resistivity (microohm-cm) |
|---|---|
| aluminum | 2.655 |
| copper | 1.673 |
| electrolytic iron | 10.1 |
| cast iron | 75–98 |
| lead | 20.65 |
| magnesium | 4.46 |
| nickel | 6.84 |
| steel | 11–45 |

John H. Perry's *Chemical Engineers' Handbook,* Fourth Edition, edited by R. H. Perry, C. H. Chilton, and S. D. Kirkpatrick, McGraw Hill Book Company, New York, 1974, gives the resistivities for a variety of materials:

| Material | Resistivity micro-ohm-cm |
|---|---|
| carbon steel | 10 |
| cast gray iron | 67 |
| ductile iron | 60 |
| cast monel | 53 |
| 201 stainless steel | 69 |
| 301 stainless steel | 73 |
| aluminum 1100 | 3 |
| lead | 21 |
| magnesium alloy AZ91B | 14 |
| cast nickel | 20.8 |

Furthermore, various cast iron alloys may have resistivities higher or lower than the range listed in the above reference. Other ferrous metals or alloys exhibit a range of resistivities.

The voltage drop in a rectangular plate may be calculated using the following equation:

$$V = ipL^2/t$$

where i=current density, amps/square centimeter

L=length, centimeters t=thickness, centimeters p=resistivity, micro-ohm centimeter V=voltage drop, volts Assuming cast steel has a resistivity of about 15 micro-ohm-cm, a current density of 0.31 amps per square centimeter (2 amps per square inch), a length of 1 meter (100 centimeters) and a thickness of 2.22 centimeters ($\frac{7}{8}$ inch) and a thickness of 1.27 centimeters ($\frac{1}{2}$ inch), the following numbers are calculated:

| Material | V, millivolts (2.22 cm) | V millivolts (1.27 cm) |
|---|---|---|
| aluminum | 3.7 | 6.5 |
| copper | 2.3 | 4.1 |
| steel | 13.9 | 24 |
| cast iron | 120 | 210 |
| ductile iron | 83 | 146 |
| magnesium | 6.2 | 10.9 |
| nickel | 9.6 | 16.9 |
| titanium | 66 | 117 |
| cast steel | 20.9 | 37 |

The resistivity for particular materials varies slightly depending upon the particular reference book used. However, the numbers are quite close.

As can be seen, the voltage drop in the electric current transmission element varies greatly depending upon the material selected.

The present invention allows materials having a high resistivity to be used for electric current transmission elements which have a very low voltage drop without requiring the use of materials which have a low resistivity, but are comparatively expensive.

Higher resistivity materials offer a greater electrical resistance than do low resistivity materials. For example, copper has a resistivity of 1.673 microohms-cm and cast iron has an average resistivity of about 86 microohm-cm. Thus, cast iron offers about 50 times more electrical resistance than would an equal size piece of copper. One can easily see why the prior art generally taught the use of low resistivity materials, such as copper, to deliver electrical current to the electrodes.

In those cases where the prior art taught the use of high resistivity materials to distribute electrical current in electrolytic cells, for example U.S. Pat. No. 4,464,242, the cells were limited in size because of the high resistance losses resulting from the high resistivity of the current distributing material. U.S. Pat. No. 4,464,242 teaches limiting cell size to 15–60 centimeters in length to avoid the necessity of using elaborate current-carrying devices.

As can be seen, the electrical resistance of a body can be minimized by: (1) decreasing the length of the current path; or (2) increasing the cross sectional area through which the current passes. The present invention takes advantage of the latter method, while the prior art concentrated on the former method.

With the electrical current feeding element of the present invention, high resistivity, inexpensive materials can be quite satisfactorily used to distribute electrical current without being restricted to smaller size cells and without having to resort to elaborate current carrying devices.

"Electrochemical cell", as used herein, means a combination of elements at least including two, electrodes and an electric current transmission element. The cell may be a monopolar cell having similarly charged electrodes or a bipolar cell having oppositely charged electrodes.

"Electrode component" means an electrode or an element associated with an electrode such as a current distributor grid or current collector. The component may be in the form of wire mesh, woven wire, punched plate, metal sponge, expanded metal, perforated or unperforated metal sheet, flat or corrugated lattice work, spaced metal strips or rods, or other forms known to those skilled in the art.

The electric current transmission element used in the terminal unit of the present invention serves as both: (1) a means to conduct electrical current to the electrode components of the unit; and (2) a support means to hold the electrode components in a desired position.

The invention employs an electric current transmission element made of a material which conducts electrical current throughout the electric current transmission element and to the electrode components of the terminal unit. The transmission element in the cell of the present invention has a large mass and a low resistance. It provides a pathway for the distribution of electrical energy substantially evenly to all parts of the electrode components. Because of its large mass and low resistance, the dimensions of a terminal unit of the present invention are not limited in size like those of the prior art. The primary electric current conduction and distribution across the entire surface area of the electrode components is effected through a low resistance body which is co-extensive with the electrode components and which may conveniently be made of a material different from the material of the electrode components.

The electric current transmission element in the terminal unit is substantially rigid. As used herein, "substantially rigid" means that it is self-supporting and does not flex under its own weight under normal circumstances, moreover it is essentially more rigid and more massive than the electrode components associated thereto.

Preferably, the material of the electric current transmission element is selected from the group consisting of iron, steel, stainless steel, nickel, aluminum, copper, magnesium, lead, alloys of each and alloys thereof.

More preferably, the material of the electric current transmission element is selected from the group consisting of ferrous materials. Ferrous materials are defined herein to mean metallic materials whose primary constituent is iron.

Surrounding the electric current transmission element is a sealing means. The sealing means forms a peripheral area of each cell and enclosed the electrode when an corresponding electrochemical unit is positioned adjacent to the terminal unit. The sealing means preferably is in the form of a window frame and covers the electric current transmission element. This minimizes the number of potential sites for leaks from the internal portion of the cell. Optionally, the sealing means is more in the form of a gasket than a window frame.

The sealing means may be a unitized body formed simultaneously with the electric current transmission element. Optionally, a portion of it may be a unitized body formed simultaneously with the electric current transmission element and a portion of it may be attached later to complete the sealing means. Optionally, the sealing means may be assembled from a plurality of pieces and attached to the electric current transmission element. The sealing means material may be metallic or plastic. For example, separate frames made of resiliently compressible material or substantially un-compressible material may be conveniently placed over the peripheral portion of the current transmission element. Such frames may be fixed to the transmission element or may be simply clamped in position upon closing the filter press assembly. When using a substantially un-compressible material, appropriate resilient gaskets may be used to insure hydraulic sealing according to normal practice. More preferably, the frame or flange portion is an integral part of the electric current transmission element, that is it is made of the same material of the thinner central portion thereof and it forms a single body without discontinuities in the material forming the electric current transmission element.

Even when the seal means is entirely formed as an integral portion of the electric current transmission element, minor portions of the seal means may be omitted or removed to allow fluid, electrical or other connections to be made between internal and external regions of electrode unit. Depending on the size of said omitted portions, replacement support for the gasket or compartment liner may be provided.

In addition, the sealing means provides a large mass of material through which electrical current can be transferred, if desired. Preferably, the thickness of the peripheral sealing means is at least about 2–3 times greater than the thickness of the electric current transmission element. More preferably, the sealing means is about 60–70 millimeters thick when the electric current transmission element is about 20–25 millimeters thick.

The electric current transmission element preferably has a sufficiently large cross sectional area to minimize its electrical resistance. The fact that the transmission element has a large cross sectional area allows the use of materials having a higher resistivity than could be used in configurations of the prior art. Thus, materials such as iron, steel, ductile iron and cast iron are perfectly suitable for use in the present invention. More specifically, materials having a resistivity as high or greater than copper may be economically used to form the electric current transmission element. More economically, materials having a resistivity greater than about 10 microohms-cm are used. Most economically, materials having resistivities as high as, or higher, than 50 microohms-cm are used.

The overall dimensions of the electric current transmission element may be larger than the monopolar electrochemical cells of the prior art because of the unique electrical distribution means provided by the electric current transmission element of the present invention. In addition, where the prior art required the use of expensive materials, such as titanium coated copper rods, the present invention may use inexpensive materials such as iron or steel. Thus, the overall dimensions of the cell of the present invention are virtually unlimited. However, as a practical matter, dimensions on the range of from about 0.25 square meter to about 4 square meters are preferably used.

The electric current transmission element preferably provides the structural integrity required to physically support the adjacent electrolyte compartments while loaded with electrolyte as well as to support the electrode components.

The electric current transmission element has a multiplicity of bosses projecting a predetermined distance outwardly from a central portion into an electrolyte compartment adjacent to the electric current transmission element. The other side may optionally have bosses but need not have them. The bosses projecting into an electrolyte compartment are capable of being mechanically and electrically connected either directly to the electrode component or indirectly to the electrode component through at least one compatible intermediate situated between the electrode component and each of the bosses. Preferably the bosses lie in the same geometrical plane. The electrode components are preferably welded to the bosses, which are substantially solid. The bosses may, however, contain internal voids, as a result of casting.

In both instances, the length of the multiple electrical current paths between the electrode component and the solid bosses projecting from the central planar body of the electric current feeder is practically negligible. Thus, the resistance is low even when the electrode component is indirectly connected to the bosses.

The bosses are integral with the electric current transmission element and are formed when the electric current transmission element is cast. Thus, they are preferably composed of the same material as the electric current transmission element. Since some materials are difficult to weld, the bosses may, however, be composed of a different material than the electric current transmission element. To form such an electric current transmission element, rods may be placed in a mold where the bosses are to be positioned, and a castable material may be cast around the rods.

The bosses are preferably spaced apart in a fashion to rigidly support the electrode components. The frequency of bosses, whether of round cross section or of elongated or rib-type cross section, per unit area of the flat electrode elements associated therewith may vary within ample limits. The separation between adjacent bosses will generally depend upon the plane resistivity of the particular electrode element used. For thinner and/or highly resistive electrode elements, the spacing of the bosses will be smaller, thus providing a more dense multiplicity of points or electrical contact; while for thicker and/or less resistive electrode elements, the spacing of the bosses may be larger. Normally the spacing between the bosses is within 5 and 30 centimeters (cm) although smaller and larger spacing may be used in accordance with overall design considerations.

Although a variety of casting methods may be used, a preferred casting process for casting the electric current transmission element using a resin bonded sand method is as follows:

(1) Foundry sand is mixed with a bonding resin and resin curing catalyst in a "mulling" machine (such resins and curing catalysts are well known in the art).

(2) The mixed sand is poured into the mold assembly (a pattern with a flask for containing the sand plus reinforcements for the sand).

(3) The top of the sand is smoothed to provide a flat surface to serve as the bottom of the completed mold.

(4) The sand/resin mixture is given time to cure. This may range from 10–30 minutes depending upon the amount of catalyst added to the sand.

(5) The mold is turned over and the pattern is removed. This completes half of the final mold, with this half commonly referred to as the "drag".

(6) The pattern is assembled with another flask plus sand reinforcements.

(7) Another mixture of sand is poured into this mold assembly, smoothed, and allowed to set. Pouring sprues are also cut or molded into the mold at this time. It is then turned over and the pattern removed. This half is referred to as the "cope".

(8) The cope and drag are visually inspected for defects. Spot repairs are made if necessary.

(9) The surface of the sand is coated with a refractory slurry mixture to help protect the sand while the casting is being poured. This coating also gives the casting an improved surface quality. This is called washing the mold.

(10) The cope is turned over and mechanically fixed on top of the drag.

(11) The mold is transported to the pouring area and set horizontally on a level floor. The mold can also be positioned vertically or at an angle to improve pour time.

(12) The casting is poured and allowed to cool.

(13) The mold assembly is taken apart and the casting removed.

A further element which this invention optionally includes is a liner made of a metal sheet fitted over those surfaces of the electric current transmission element which would otherwise be exposed to the corrosive environment of the electrolyte compartment environment.

Preferably, the liner is an electrically conductive metal substantially resistant to the corrosion of the electrolyte compartment environment. Preferably the liner is formed so as to fit over, and connect to, the electric current transmission element at the bosses and, more preferably, at the ends of the bosses.

More preferably, the liner is sufficiently depressed around the spaced bosses toward the electric current transmission element in the spaces between the bosses so as to allow free circulation of the fluids between the lined electric current transmission element and the separator or the adjacent electrolyte compartment. Additionally, the liner may have embossed features for fluid directing purposes. These additional embossed features are optionally connected to the electric current transmission element.

It is not necessary that the liner be depressed around the spaced bosses as to contact the planar surface of the electric current transmission element, preferably the liner will rest solely over the top surfaces of the bosses and over the surface of the flange portion of the electric current transmission element.

In situations where the liner is not weldably compatible with the metal of the electric current transmission element, then in order to be able to weld the liner to the electric current transmission element, metal coupons may be situated in an abutting fashion between the bosses and the liner. The metal layer of the coupons which abuts each boss is weldably compatible with the material which the bosses are made and accordingly being welded to said bosses. The metal layer of that side of the coupons abutting the liner is weldably compatible with the metallic material of which the liner is made and accordingly is welded to said liner so that the liner is welded to the bosses through the coupons. In most instances wafers made of a single metal or metal alloy serve quite well as intermediates. In some cases these coupons may need to be bi-layer to achieve compatible welds between the boss and the liner.

Preferably, a second wafer 31 is placed between wafer 30 and the liner 26. The second wafer is desirable because it minimizes corrosion. When only one vanadium wafer is used between a titanium pan and a ferrous electric current transmission element, it has been discovered that the corrosive materials contacting the liner during operation of the cell to produce chlorine and caustic seem to permeate into the titanium-vanadium weld and corrode the weld. Rather than use a thicker pan, it is more economical to insert a second wafer 31. The second wafer 31 is preferably sufficiently thick to minimize the possibility of the corrosive materials permeating into the central support element.

In the situation where the liner is a titanium material and the bosses are a ferrous material, then it is preferred to have vanadium wafers serve as the weldably compatible metal intermediates interposed between the bosses and the adjacent liner so that the titanium liner can be welded to the ferrous material bosses through the vanadium wafers. Vanadium and nickel are examples of metals which are weldably compatible with both titanium and ferrous material.

Another way of connecting the liner to the electric current transmission element, when these metals are weldably incompatible, is through the use of explosion bonding or diffusion bonding. Such methods are known in the art. See, for example, U.S. Pat. No. 4,111,779.

In many instances it is highly desirable that the liner extend over the lateral face of the sealing means to form a sealing face thereat for the separator when the terminal unit is positioned against electrochemical cell units.

In chlor-alkali cells, a liner is most commonly used in anode terminal cells and is less frequently used to line cathode terminal cells. However, those processes where the electrochemical cell is used to produce caustic concentrations greater than about 22 weight percent caustic solution, a catholyte liner may be desirably used. The catholyte liner is made from an electrically conductive material which is substantially resistant to corrosion due to the catholyte compartment environment. Plastic liners may be used in some cases where provision is made for electrically connecting the cathode to the cathode bosses throughout the plastic. Also, combinations of plastic and metal liners may be used. The same is true for anolyte liners.

The liners for the catholyte terminal unit are preferably selected from the group consisting of ferrous materials, nickel, stainless steel, chromium, monel and alloys thereof.

The liners for the anode terminal unit are preferably selected from the group consisting of titanium, vanadium, tantalum, columbium, hafnium, zirconium, and alloys thereof.

In cases where the terminal unit is used in a process to produce chlorine and caustic by the electrolysis of an aqueous brine solution, it is most preferred that the anolyte terminal units be lined with titanium or a titanium alloy and the electric current transmission element be of a ferrous material.

The terminal units of the present invention may be either a cathode half-cell or an anode half-cell. "Half-cell" means a cell member having a electric current transmission element and only one electrode. The electrode can be either a cathode or an anode, depending upon the design of the overall cell configuration. The terminal units, being either anode or cathode, will consist of one active area (that is, where product is being made) and one inactive area (that is, where product is not being made). The definition of the active area whether anode or cathode is the same as previously discussed. The inactive area completes the definition of a monopolar electrolytic cell assembly. This section of the cell can be used to hold the assembly together as in a hydraulic squeezer.

However, in monopolar uses, the terminal units are preferably cathodes. They may have an electric current transmission element similar to the one used for the intermediate electrode units, however the external face thereof may be flat or provided with stiffening ribs. If liners on the catholyte side are used, also the terminal units will have a similar liner disposed over its internal surface and contoured around the bosses extending from the internal surface of the electric current transmission of the terminal unit.

Each terminal unit has an electrical connection means connecting an external power supply to the electric current transmission element. The connecting means may be integral with, or attached to, the sealing means or it may pass through an opening in the sealing means and connect to the electric current transmission element. The electrical connection may also be connected to the electric current transmission element at a plurality of locations around the sealing means to improve the current transmission into the electric current transmission element. The electrical connection means may be an opening in the sealing means or in the transmission element to which a power supply cable is attached.

More preferably, the electrical connection means is an integral part of the electric current transmission element. That is, the electrical connection means is made of the same material of the central portion thereof and it forms a single body without discontinuities in the material forming the electric current transmission body. Most practically, this connection means is an extension of the central portion of the body, which projects outside the perimeter of the frame or sealing flange portion along one side thereof, for a length sufficient to provide easy connection to a bus bar.

In the case that the frame or flange portion of the electric current transmission is an integral part of the feeder body itself, then the electrical connection means may be provided by the edge of the flange portion itself. That is, a flexible copper cable or bus bar may be bolted directly on the edge surface of the flange portion. The electrical contact surface may be coated with a material particularly suitable for electrical contact, such as, for example, copper or silver.

FIG. 1 shows a perspective view of one embodiment of the terminal unit 10 of the present invention.

The terminal unit 10 includes an electric current transmission element 14 having a plurality of bosses 18 projecting outward from the sides of the transmission element. The transmission element 14 comprises a central portion 17 and bosses 18 is surrounded on its peripheral edges with a sealing means 16 having a thickness greater than the transmission element 14. An opening 50 passes through the sealing means 16 to provide a passageway for the introduction of reactants into the unit or a passageway for the removal of products and depleted electrolyte from the unit. Electrode component 36 is positioned against bosses 18 in a position to be substantially coplanar or subplanar to a surface 16B of the sealing means 16.

An electrical connection means 21 is positioned outside of and an integral part of the sealing means 16. The connection means 21 is connected to a power supply (not shown) at 20 of connection means 21. Electrical current flows from the connection means 21, through the sealing means 16, through the electric current transmission element 14, and to bosses 18. Thereafter, the current flows through the bosses 18, through a liner (if present) and to the electrode component 36.

Figure 2:
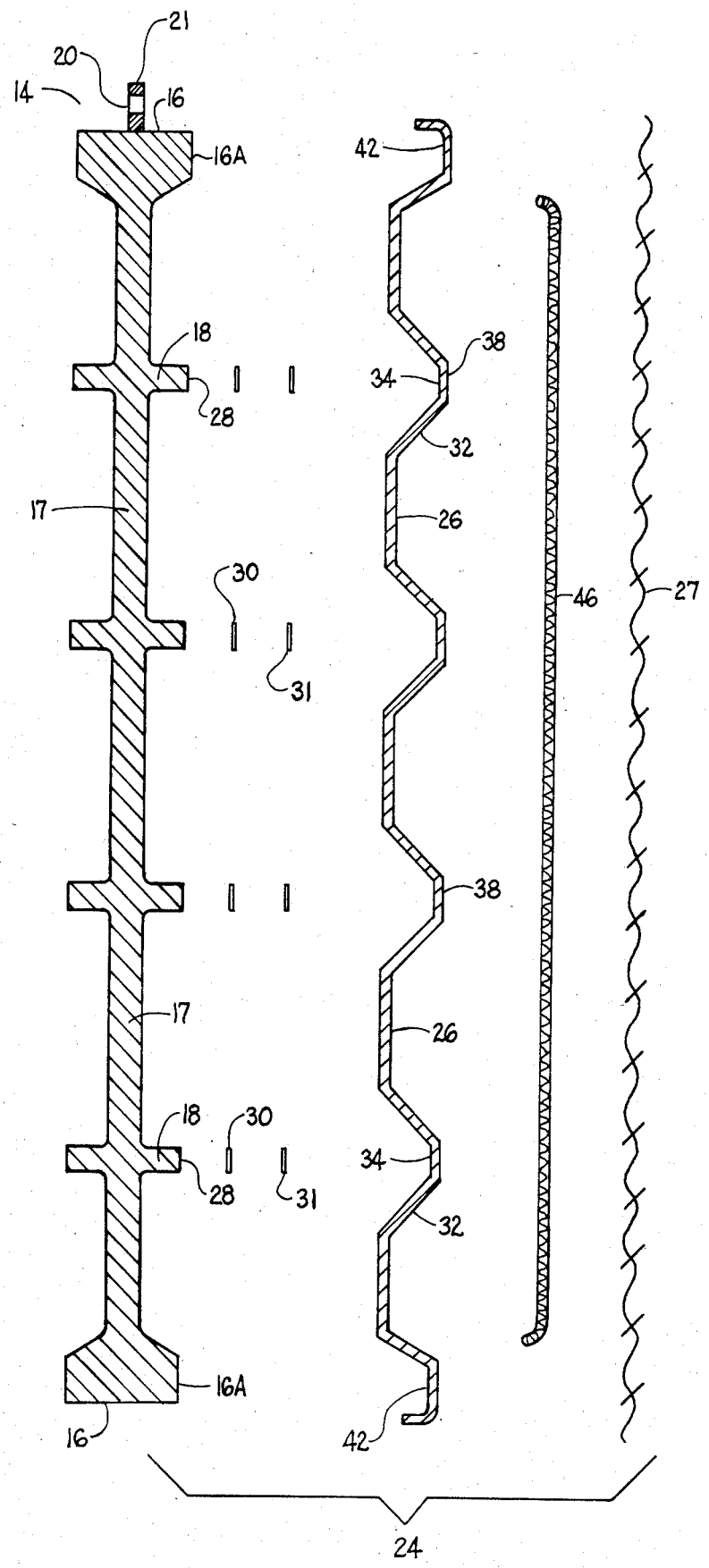
FIG. 2 is an exploded, sectional side view of the terminal unit of FIG. 1.

FIG. 2 shows a terminal unit 10 having an electric current transmission element 14. The transmission element 14 has a plurality of bosses 18. The electric current transmission element 14 is surrounded on its peripheral edges with a sealing means 16. The sealing means 16 is thicker than the electric current transmission element 14. This provides electrolyte chamber 22, when an electrochemical unit is stacked adjacent to the terminal unit.

The illustrated unit uses liner 26 to cover electric current transmission element 14 on the side exposed to electrolyte. The liners may be made, for example for the anode terminal unit, of single sheets of thin titanium. Liner 26 may be hot formed by a press in such a fashion so to fit over and to be near or substantially against the surfaces of the electric current transmission element 14 on its side. Liner 26 may optionally cover sealing means face **16*a*. This protects the electric current transmission element 14 from the corrosive environment of the cell. Electric current transmission element 14 is preferably constructed in such a fashion so that its sealing means 16 serves not only as the peripheral boundary of an electrolyte compartment 22, but to seal adjacent units and form electrolyte chamber 22**.

Preferably the liner is formed with a minimum of stresses in it to minimize warpage. Avoiding these stresses in the liner is accomplished by hot forming the liner in a press at an elevated temperature of about 900° F. to about 1300° F. Both the liner metal and press are heated to this elevated temperature before pressing the liner into the desired shape. The liner can be held in the heated press and cooled under a programmed cycle to prevent formation of stresses in it as it cools to room temperature.

If liner 26 is titanium and electric current transmission element 14 is a ferrous material, they may be connected by resistance welding or capacitor discharge welding. Resistance or capacitor discharge welding is accomplished indirectly by welding liner 26 to the ends 28 of the bosses 18 through vanadium wafers 30. Vanadium is a metal which is weldably compatible with titanium and ferrous materials. Weldably compatible means that one weldable metal will form a ductile solid solution with another weldable metal upon the welding of the two metals together. Titanium and ferrous materials are not normally weldably compatible with each other, but both are weldably compatible with vanadium. Hence, vanadium wafers 30 are used as an intermediate metal between the ferrous bosses 18 and the titanium liner 26 to accomplish the welding of them together to form an electrical connection between liner 26 and the electric current transmission element 14 as well as to form a mechanical support means for the electric current transmission element 14 to supporting liner 26.

The general fit of the liner 26 against the electric current transmission element 14 can be seen from FIG. 2. Liner 26 has indented hollow caps 32 pressed into them. These caps 32 have an internal contour which easily accommodates the external contour of the bosses 18. They are, however, hollow instead of solid as are the bosses 18. Caps 32 are sized and spaced so that they fit over and around bosses 18. Caps 32 are sized in depth of depression so that their interior ends abut the vanadium wafers 30 when the vanadium wafers 30 are abutting the flat ends 28 of bosses 18 and when these elements are welded together. The shape of these bosses and caps is not critical. They could be square, rectangular, conical, cylindrical, or any other convenient shape when viewed in sections taken either parallel or perpendicular to the central portion. The bosses may have an elongated shape to form a series of spaced ribs distributed over the surface of the electric current transmission. Furthermore, the caps may be one shape and the bosses another. However, their ends 28 are preferably flat and all lie in the same imaginary geometrical plane. In fact these bosses and caps can be shaped and located so as to guide electrolyte and gas circulation, if desired.

The liner 26 may be resistance welded at the interior ends 34 of its intended caps 32 to the ends 28 of bosses 18 through the interposed, weldably compatible, vanadium wafers 30.

The linear surfaces 42 mate with sealing means surfaces 16A. They may optionally be welded at these points.

Figure 3:
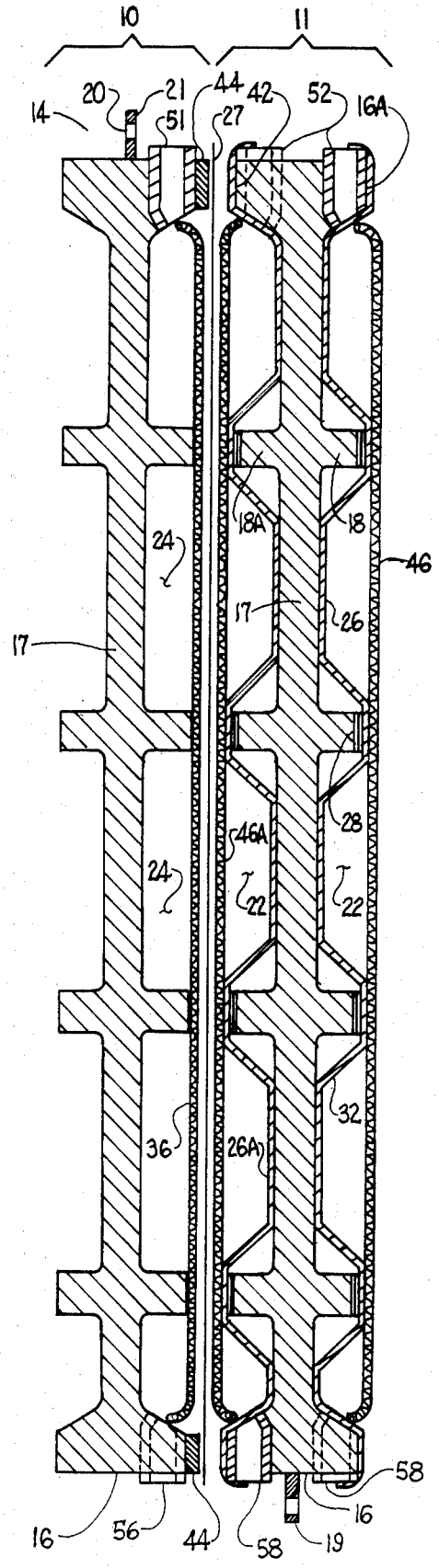
FIG. 3 is a cross-sectional side view of the terminal unit 10 and a monopolar electrochemical unit 11 as they would appear in a cell series.

An ion exchange membrane 27 may be positioned between the terminal unit 10 and the electrochemical unit 11 as shown in FIG. 3. Representative of the types of ion exchange membranes envisioned for use with this invention are those disclosed in the following U.S. Pat. Nos. 3,909,378; 4,329,435; 4,065,366; 4,116,888; 4,126,588; 4,209,635; 4,212,713; 4,251,333; 4,270,996; 4,123,336; 4,151,053; 4,176,215; 4,178,218; 4,340,680; 4,357,218; 4,025,405; 4,192,725; 4,330,654; 4,337,137; 4,337,211; 4,358,412; and 4,358,545. These patents are hereby incorporated by reference for the purpose of the membranes they disclose.

An electrical connection 21 is positioned on the sealing means 16 to act as a connector for a power supply (not shown). The connection 21 conducts electrical current to the electric current transmission element. The connector 21 may take different forms and may be positioned in different locations of the unit. For example, it may be located on or integrally with the electric current transmission element 14. More than one connector may be employed.

Electrode components (36 in FIG. 1 and 46 in FIG. 2) are preferably foraminous structures which are substantially flat and may be made of a sheet of expanded metal perforated plate, punched plate or woven metallic wire. Optionally the electrode components may be current collectors which contact an electrode or they may be electrodes. Electrodes may optionally have a catalytically active coating on their surface. Referring to FIG. 2, electrode component 46 may be welded directly to the outside of the flat ends 38 of indented caps 32 of liners 26. These welds form an electrical connection and provide a mechanical support means for electrode component 46. Additionally, other elements may be in conjunction with component 46. Special elements or assemblies for zero gap configurations or SPE membranes may be used.

The electric current transmission element may be used in conjunction with a solid polymer electrolyte cell or zero gap cells wherein the electrode is embedded in, bonded to, or pressed against an ion exchange membrane. In these cases, it is desirable to use a current collector between the bosses and the electrode. The current collector distributes electrical current to the electrode. Such cells are illustrated in U.S. Pat. Nos. 4,457,823; 4,457,815; 4,444,623; 4,340,452; 4,444,641; 4,444,639; 4,457,822; and 4,448,662.

Of course, it is within the scope of this invention for the electrolysis cell formed between the terminal unit and an adjacent electrochemical cell may be a multicompartment electrolysis cell using more than one membrane, e.g., a three-compartment cell with two membranes spaced from one another so as to form a compartment between them as well as the compartment formed on the opposite side of each membrane between each membrane and its respective adjacent filter press monopolar unit.

FIG. 3 illustrates an assembly of terminal unit 10 and an electrochemical unit 11 used in a monopolar fashion. These two articles are positioned in operable combination with each other. Terminal units 10 do not have a liner while electrochemical unit 11 has a liner 26 and 26A on its sides. Unit 11 is designed to carry an electrical charge opposite that of the terminal unit 10. For example, unit 10 may be connected to the negative pole of a power supply through electrical connections 21, thereby become negatively charged and act as a cathode. Similarily, unit 11 can be connected to the positive pole of a power supply through electrical connection 19, become positively charged, and act as an anode. Each unit is separated from an adjacent unit by an ion exchange membrane 27.

Assemblying the two articles 10 and 11 adjacent to each other creates a number of cavities, which act as electrolyte chambers. Catholyte chamber 24 and anolyte chambers 22 are formed. Catholyte chambers 24 are illustrated as having two passageways 51 and 56 connecting the chamber to the exterior of the cell. These passageways may be used to introduce reactants into the cell, for example, through passageway 56, and to remove products from the cell, through passageway 51. Likewise, anolyte chambers 22 have inlet passageways 58 and outlet passageways 52.

There is a channel 50 in the sealing means suitable for receiving the nozzles, whether they are attached to the pan, or attached to the sealing means.

Each unit is equipped with electrode components. In the illustrated embodiment, electrochemical unit 11 illustrated as having two anodes 46 and 46A and the terminal unit 10 has one cathode 36.

Figure 4:
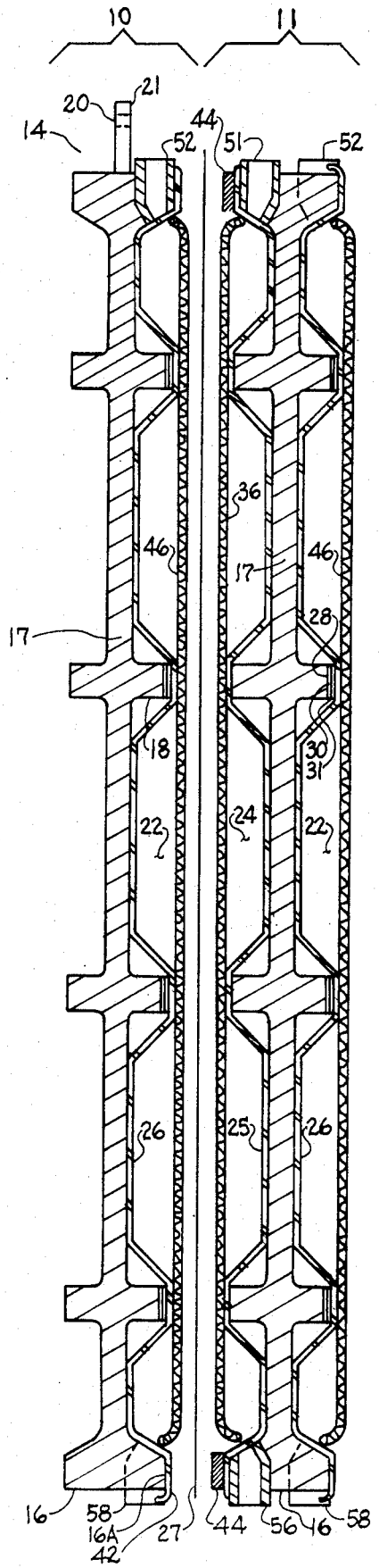
FIG. 4 is a cross-sectional side view of the terminal unit 10 and a bipolar electrochemical unit 11 as they would appear in a cell series.

FIG. 4 illustrates an assembly of terminal unit 10 and an electrochemical unit 11 used in a bipolar fashion. This embodiment shows an anode terminal unit 10 having an electrochemical unit 11 stacked adjacent to it.

Many of the elements of these embodiments of the invention have been previously discussed. For that reason, the main differences will be pointed out at this point. Bipolar cells conduct electrical current from one end of a series of cells to the other end of the series. The current passes through the electric current transmission element from one side to the other side. Only the terminal units of a bipolar series have electric connection means 21. Note that electrochemical unit 11 does not have an electric connection means 21. It receives current from an adjacent bipolar unit (not shown).

These two units are positioned in operable combination with each other. The terminal unit 10 and the electrochemical unit 11 both are lined on both sides, of their electric current transmission elements. An anode side of the bipolar unit and of the terminal unit are lined with a titanium liner 26, while the cathode side of the bipolar unit is lined with a nickel liner 25. The pan and the sealing means are attached and mated in the same manner as discussed previously in reference to other drawings.

There are cathode compartments 24 and anode compartments 22, cathodes 36 and anode components 46. The terminal unit 10 has an inlet 58 and an outlet 52 for introducing reactants into the cell and for removing products of electrolysis from the cell. The adjacent electrochemical unit has inlets and outlets 56 and 51 for introducing and removing material from the cell compartment 24, and inlets and outlets 52 and 58 for introducing and removing materials from compartment 22. The anode and the cathode are separated from each other with an ion exchange membrane 27. Gaskets 44 are used to help seal the compartments.

For fluid sealing purposes between the membrane 27, and sealing means surface **16*a*, it is preferred for liner 26 and 25 to be formed in the shape of a pan with an off-set lip 42 extending around its periphery. Lip 42 fits flush against the lateral face 16*a* of sealing means 16. The periphery of membrane 27 fits flush against liner lip 42, and a peripheral gasket 44 fits flush against the other side of the periphery of membrane 27. In a cell series, as shown in FIG. 3, the gasket 44 fits flush against the lateral face 16*b* of the sealing means 16 and flush against membrane 27 when there is no pan 26**.

Although only one gasket 44 is shown, this invention certainly encompasses the use of gaskets on both side of membrane 27. It alco encompasses the situation where no lip 42 is used.

In an electrolysis cell series wherein aqueous solutions of sodium chloride are electrolyzed to form caustic and/or hydrogen gas in a catholyte compartment, then ferrous materials such as steel are quite suitable for the catholyte compartment metal components at most cell operating temperatures and caustic concentrations, e.g., below about 22% caustic, concentration and at cell operating temperatures below about 85° C. Hence, if the electric current transmission element 14 is made of a ferrous material such as steel, and if caustic is produced at concentrations lower than about 22% and the cell is to be operated below about 85° C., then a protective linear is not needed but may optionally be used with the catholyte unit to protect the element 14 from corrosion.

It will be noticed that the flat-surfaced electrodes 36, 46 and 46A have their peripheral edges rolled inwardly toward the electric current transmission element 14 away from the membrane 27. This is done to prevent the sometimes jagged edges of these electrodes from contacting the membrane 27 and tearing it. Those skilled in the art know other ways of installing electrodes to accomplish the same purpose.

In operating the present electrochemical cell as a chlor-alkali cell, a sodium chloride brine solution is fed into anolyte compartments 22 and water is optionally fed into catholyte compartments 24. Electric current from a power supply (not shown) is passed between anodes 46 and 46A and cathode 36. The current is at a voltage sufficient to cause electrolytic reactions to occur in the brine solution. Chlorine is produced at the anode 46 and 46A while caustic and hydrogen are produced at the cathode 36.

Optionally, an oxygen containing gas may be fed to one side of the cathode and the cathode operated as an oxygen depolarized cathode. Likewise, hydrogen may be fed to one side of the anode and the anode operated as a depolarized anode. The types of electrodes and the procedures of operating them are well known in the art. Conventional means for the separate handling of gaseous and liquid reactants to a depolarized cathode may be used.

In operating the cell series for the electrolysis of NaCl brine to produce chlorine and caustic, certain operating conditions are generally used. In th anolyte compartment a pH of from about 0.5 to about 5.0 is desired to be maintained. The feed brine preferably contains only minor amounts of multivalent cations (less than about 80 parts per billion when expressed as calcium). More multivalent cation concentration is tolerated with the same beneficial results if the feed brine contains carbon dioxide in concentrations lower than about 70 ppm when the pH of the feed brine is lower than 3.5. Operating temperatures can range from 0° to 250° C., but preferably above about 60° C. Brine purified from multivalent cations by ion-exchange resins after conventional brine treatment has occurred is particularly useful in prolonging the life of the membrane. A low iron content in the feed brine is desired to prolong the life of the membrane. Preferably the pH of the brine feed is maintained at a pH below 4.0 by the addition of hydrochloric acid.

The nozzles used in the present cell may take a variety of designs to minimize the pressure drop encountered by gases or liquids as they pass into, or out of, the cell.

A particularly useful design and method for installing a nozzle are as follows:

A plurality of nickel or titanium nozzles are formed, for example by investment casting. The nozzle casting may be machined to the desired size. A short length (about 2¾ inches) of metal tubing is welded to the nozzle. This tubing will serve as the external connector to introduce, or remove, electrolyte or gases to, or from, the cell. A number of slots are machined into each electric current transmission element at a plurality of desired positions to receive the nozzles. The slots are of a size to correspond to the thickness of the nozzle to be inserted into the slot, to assure a seal when the elements of the cell are ultimately assembled. If a liner is used, it is cut to fit around the nozzle. If a nozzle is used, it is preferably welded to the liner. The liner-nozzle assembly is then placed in the cell. The liner caps are then welded to the cell bosses.

Preferably the pressure in the catholyte compartment is maintained at a pressure slightly greater than that in the anolyte compartment, but preferably at a pressure difference which is no greater than a head pressure of about 1 foot of water.

Preferably the operating pressure of the cell is maintained at less than 7 atmospheres.

Usually the cell is operated at a current density of from about 1.0 to about 4.0 amperes per square inch, but in some cases operating above 4.0 amps/in.$^2$ is quite acceptable.

Accordingly a compartment inlet duct 56, a compartment outlet duct 50, a compartment inlet duct 58, and a compartment outlet duct 52 are optionally provided in the body of the sealing means 16 in that part of the sealing means which contacts their respective compartment 22 and compartment 24. When there are liners 26 and 26A, in these compartments, then corresponding openings are provided in the liners. Examples of these openings can be seen in FIG. 1 wherein a compartment outlet 50 is shown cast in the electric current transmission element 14.

It should be noted here that although bosses 18 are shown in a back to back relationship across central portion 14, they need not be. They can also be offset from each other across portion. They may have more than one cross-sectional configuration. The liner may have caps which have no corresponding bosses.

The terminal unit of the present invention may be used in conjunction with a solid polymer electrolyte cell wherein the electrode is embedded in or bonded to an ion exchange membrane. In this case, it is desirable to use a current collector between the bosses and the electrode. The current collector distributes electrical current to the electrode. Solid polymer electrodes are illustrated in U.S. Pat. Nos. 4,343,690; 4,468,311; 4,340,452; 4,224,121; and 4,191,618.

There are a variety of preferred processing conditions for the operation of the present monopolar electrochemical cell. For example, ion exchange membranes containing sulfonic or carboxylic acid ion exchange active sites. Optionally, the ion exchange membrane may be a bi-layer membrane having one type of ion exchange active sites in one layer and another type of ion exchange active sites in the other layer. The membrane may be reinforced to impair deforming during electrolysis or it may be unreinforced to maximize the electrical conductivity through the membrane.

In chlor-alkali processes, it is preferable to maintain the pH of the anolyte at a range of from about 0.5 to about 5.0 during electrolysis. In most cases it is desirable to operate the electrolytic cell of the present invention at a current density as high as possible, to minimize the number of cells required to produce a given amount of products. The current density preferably used in the present electrolytic cells is from about 0.5 to about 5.0 amps per square inch of anode surface.

Multivalent ions in the electrolyte tend to foul the ion exchange membrane. Thus, it is desirable to minimize the concentration of multivalent ions. Preferably, they are kept at concentrations less than about 80 parts per billion expressed as calcium in the electrolyte. Feed brine and feed water may be contacted with a chelating ion exchange resin to reduce the concentration of multivalent ions to a level of less than about 80 parts per billion expressed as calcium of solution, prior to the feed stream being introduced into the electrolytic cell.

Another way to minimize fouling of the ion exchange membrane is to remove carbon dioxide from the electrolyte. Preferably, the carbon dioxide concentration in the electrolyte is less than about 70 parts per million as measured just prior to the brine being electrolyzed when the pH of the brine is maintained at a level lower than 3.5 by a process which includes the addition of hydrochloric acid to the brine prior to its being electrolyzed. It has also been determined that it is desirable to use electrolyte having a silica concentration of less than about 4 milligrams of silica per liter of electrolyte. Sulfate is another ion that is preferably minimized. It is desired to keep the sulfate level of the electrolyte at a level less than about 5 grams sulfate per liter of electrolyte.

Using ion exchange membranes, it is possible to produce sodium hydroxide solutions having a sodium chloride concentration less than about 300 parts per million NaCl based on 100% sodium hydroxide.

The pressure in the catholyte chamber may conveniently be maintained at a slightly greater pressure than the pressure of the anolyte compartment so as to gently urge the permselective, ion exchange membrane separating the two compartments toward and against a "flat plate" foraminous anode disposed parallel to the planarly disposed membrane; which anode is electrically and mechanically connected to the anode bosses of the electric current transmission element.

The catholyte or the anolyte may be circulated through their respective compartments, as is known in the art. The circulation can be forced circulation, or gas lift circulation caused by the gases rising from the electrodes where they are produced.

The present invention is suitable for use with the newly developed solid polymer electrolyte electrodes. Solid polymer electrolyte electrodes are an ion exchange membrane having an electrically conductive material embedded in or bonded to the ion exchange membrane. Such electrodes are well known in the art and are illustrated in, for example, U.S. Pat. Nos. 4,457,815 and 4,457,823. These two patents are hereby incorporated by reference for the purposes of the solid polymer electrolyte electrodes which they teach.

In addition, the present invention is suitable for use as a zero gap cell. A zero gap cell is one in which at least one electrode is in physical contact with the ion exchange membrane. Optionally, both of the electrodes may be in physical contact with the ion exchange membrane. Such cells are illustrated in U.S. Pat. Nos. 4,444,639; 4,457,822; and 4,448,662. These patent are incorporated by reference for the purposes of the zero gap cells that they illustrate.

In addition, other cell components may be used in the cell of the present invention. For example, the mattress structure taught in U.S. Pat. No. 4,444,632 may be used to hold the ion exchange membrane in physical contact with one of the electrodes of the cell. Various mattress configurations are illustrated in U.S. Pat. No. 4,340,452. The mattresses illustrated in U.S. Pat. No. 4,340,452 may be used with both solid polymer electrolyte cells and zero gap cells. These patents are incorporated by reference for the purposes of the cell elements that they teach.

EXAMPLE 1

Four (4) electric current transmission elements were cast for a nominal 61 cm (2 feet) by 61 cm (2 feet) monopolar electrolyzer.

All electric current transmission elements were cast of ASTM A536, GRD65-45-12 ductile iron and were identical in regard to as-cast dimensions. Finished castings were inspected and found to be structurally sound and free of any surface defects. Primary dimensions included: nominal 61 cm (24 in.) by 61 cm (24 in.) outside dimensions, a 2 cm (0.80 in.) thick central barrier, 16, 2.5 cm (one in). diameter bosses located on each side of the central barrier and directly opposing each other, a 2.5 cm (one in.) wide sealing means area 6.4 cm (2.5 in.) thick around the periphery of the cell casting. Machined areas included the sealing means faces (both sides parallel) and the top of each boss (each side machined in a single plane and parallel to the opposite side).

The cathode cell incorporated 0.9 mm (0.035 in.) thick protective nickel liners on each side of the cell structure. Inlet and outlet nozzles, also constructed of nickel were prewelded to the liners prior to spot welding the liners to the cell structure. Final assembly included spot welding catalytically coated nickel electrodes to the liners at each boss location.

The cathode terminal unit was similar to the cathode cell with the exception that a protective nickel liner was not required on one side, as well as the lack of an accompanying nickel electrode.

The anode cell incorporated 0.9 mm (0.035 in.) thick protective titanium liners on each side of the cell structure. Inlet and outlet nozzles, also constructed of titanium were prewelded to the liners prior to spot welding the liners to the cell structure. Final assembly included spot welding titanium electrodes to the liners at each boss location through an intermediate of vanadium metal. The anodes were coated with a catalytic layer of mixed oxides of ruthenium and titanium.

The anode terminal unit was similar to the anode cell with the exception that a protective titanium liner was not required on one side, as well as the lack of an accompanying titanium electrode.

EXAMPLE 2

Two monopolar units and two terminal units as prepared in Example 1 were used to form an electrolytic cell assembly.

Three electrolytic cells were formed by assemblying an anode end member, a monopolar cathode unit, a monopolar anode unit, and a cathode end member with three sheets of a fluoropolymer ion exchange membrane. The membranes were gasketed on only the cathode side such that the electrode-to-electrode gap was 1.8 mm (0.071 inches) and the cathode-to-membrane gap was 1.2 mm (0.049 inches). The operating pressure of the catholyte was 140 mm of water (0.2 pounds per square inch) greater than the anolyte pressure to hydraulically hold the membrane against the anode.

The monopolar, gap electrochemical cell assembly described above was operated with forced-circulation of the electrolytes. Total flow to the three anode compartments operating in parallel was about 4.9 liters per minute (1.3 gallons per minute). Makeup brine to the recirculating anolyte was about 800 milliliters per minute of fresh brine at 25.2 weight percent NaCl and pH 11. The recirculating anolyte contained about 19.2 weight percent NaCl and had a pH of about 4.5. The pressure of the anolyte loop was about 1.05 kilograms/square centimeter (15 pounds per square inch gauge). Parallel feed to the three cathode compartments totaled about 5.7 liters/minute (1.5 gallons per minute); condensate makeup to this stream was about 75 milliliters per minute. The cell operating temperature was about 90° celcius. Electrolysis was conducted at about 2 amps per square inch.

Under these conditions, the electrochemical cell assembly produced about 33 weight percent NaOH and chlorine gas with a purity of about 98.1 volume percent. The average cell voltage was about 3.10 volts and the current efficiency was estimated to be about 95%.

Cell voltages were stable and no electrolyte leakage was observed during operation.

EXAMPLE 3

Six (6) electric current transmission elements were cast for a nominal 61 cm (2 feet) by 122 cm (4 feet) monopolar electrolyzer. These elements were later used to construct three (3) cathode monopolar electrolytic cells and three (3) anode monopolar electrolytic cells.

All cell structures were cast of ASTM A536, GRD65-45-12 ductile iron and were identical in regard to as-cast dimensions. Finished castings were inspected and found to be structurally sound and free of any surface defects. Primary dimensions included: nominal 58 cm by 128 cm outside dimensions, a 2.2 cm (0.80 in.) thick central barrier, a 2.5 cm (one inch) wide sealing means area 6.4 cm (2.5 in.) thick around the periphery of the cell casting, twenty-eight, 2.5 cm (1 in.) diameter bosses on one side of the central barrier and thirty, 2.5 cm (1 in.) diameter bosses on the opposite side of the central barrier. These bosses were offset from one another with regard to the central barrier, but could also be cast directly opposed to each other if so desired.

Machined areas included the sealing means faces (both sides parallel) and the top of each boss (each side machined in a single plane and parallel to the opposite side). Nozzle notches (inlet and outlet on each side) were also machined to finished dimensions.

The cathode cell incorporated 0.9 mm (0.035 in.) thick protective nickel liners on each side of the cell structure. Inlet and outlet nozzles, also constructed of nickel, were prewelded to the liners prior to spot welding the liners to the cell structure. Final assembly included spot welding nickel electrodes to the liners (both sides) at each boss location.

The anode cell incorporated 0.9 mm (0.035 in.) thick protective titanium liners on each side of the cell structure. Inlet and outlet nozzles, also constructed of titanium, were prewelded to the liners prior to spot welding the liners to the cell structure. Final assembly included spot welding titanium electrodes to the liners (both sides) at each boss location.

The foraminous titanium electrodes comprised a 1.5 mm thick titanium sheet expanded to an elongation of about 155%, forming diamond-shaped openings of 8×4 mm in the sheet and thence coated with a catalytic layer of a mixed oxide of ruthenium and titanium. As described above, the coated titanium sheet was spot welded to the liner at each boss location.

A thinner 0.5 mm thick titanium sheet expanded to an elongation of about 140%, forming diamond-shaped openings of 4×2 mm and also coated with a catalytic layer of a mixed oxide of ruthenium and titanium was spot welded over the thicker sheet.

The foraminous nickel cathodes comprised a coarse 2 mm thick nickel sheet expanded to form openings of 8×4 mm spot welded to the nickel liner at each boss location. Three layers of corrugated knitted fabric of nickel wire of 0.2 mm diameter forming a resiliently compressible mat were placed over the coarse nickel-sheet.

A fly-net type nickel screen made with 0.2 mm diameter nickel wire coated with a catalytic deposit of a mixture of nickel and ruthenium was placed over the resiliently compressible mat.

The complete filter-press cell assembly was closed interposing cation-exchange membrane between adjacent formainous cathodes and foraminous anodes elements.

The membranes resulted resiliently compressed between the opposing surfaces of the coated thinner titanium sheet (anode) and the fly-net type coated nickel screen (cathode).

Electrolysis of sodium chloride solution was carried out in the cell at the following operating conditions:

| | |
|---|---|
| Anolyte concentration: | 200 g/liter of NaCl |
| Anolyte pH: | 4–4.1 |
| Catholyte concentration: | 35% by weight of NaOH |
| Temperature of anolyte: | 90° C. |
| Current density: | 3000 A/m$^2$ |

After 60 days of operation, the observed cell voltage was comprised between 3.07 and 3.23 volts, the cathodic efficiency was estimated at about 95% and the chlorine gas purity was about 98.6%. No leakages or other problems were observed and the cell operated smoothly.

We claim:

1. An electrochemical terminal unit suitable for use in monopolar or bipolar electrochemical cells comprising:
   - a one-piece, cast metal electric current transmission element in the form of a substantially planar, continuous electrically conductive body having a plurality of bosses on at least one face of the electric current transmission element;
   - a metal liner having a profile matching the face of the electric current transmission element having the plurality of bosses;
   - wherein said metal liner is made from a corrosion resistant metal and disposed over the face of said electric current transmission element having the bosses;
   - foraminous electrode components disposed over said liner and resting over said raised portions, said electrode components and said metal liner being connected together at at least a portion of said bosses; and
   - an electrical connection means for connecting a pole of an electric current power supply on at least one of the edges of said electric current transmission element.

2. The terminal unit of claim 1 wherein at least one electrode component is an electrode.

3. The terminal unit of claim 2 wherein at least one electrode is catalytically coated.

4. The terminal unit of claim 1 wherein at least one electrode component is hydraulically permeable.

5. The terminal unit of claim 1 wherein at least one electrode component is an uncatalyzed current collector.

6. The terminal unit of claim 1 wherein at least one electrode component is substantially incompressible.

7. The terminal unit of claim 1 wherein at least one electrode component is resiliently compressible.

8. The terminal unit of claim 1 wherein at least one electrode component is directly connected to the electric current transmission element.

9. The terminal unit of claim 1 wherein at least one electrode component is indirectly connected to the electric current transmission element through a liner.

10. The terminal unit of claim 1 wherein electric current transmission element is hydraulically impermeable.

11. The terminal unit of claim 1 wherein the electric current transmission element is composed of a castable metal.

12. The terminal unit of claim 1 wherein the electric current transmission element is composed of a metal selected from the group consisting of: iron, steel, stainless steel, nickel, aluminum, copper, magnesium, lead, alloys of each and alloys thereof.

13. The terminal unit of claim wherein the electric current transmission means is selected from the group consisting of ferrous metals.

14. The terminal unit of claim 1 wherein the bosses have a frustoconical shape.

15. The terminal unit of claim 1 wherein the bosses have an elongated rib shape.

16. The terminal unit of claim 1 wherein the electric current transmission element is surrounded on its peripheral edges with a sealing means having a thickness such that its surface is in a plane above the ends of the plurality of bosses.

17. The terminal unit of claim 16 wherein the liner is co-extensive with the sealing means.

18. The terminal unit of claim 1 wherein the liner is connected to the bosses by welding through a metal intermediate disposed between the bosses and the liner, the metal of the metal intermediate being not only weldable itself, but also being weldably compatible with both the electric current transmission element and liner to the point of being capable of forming a ductile solid solution with them at welds of them upon their welding.

19. The terminal unit of claim 1 wherein the electric current transmission element is a ferrous material and the liner is a metallic material selected from the group consisting of titanium, vanadium, tantalum, columbium, hafnium, zirconium, and alloys thereof.

20. The terminal unit of claim 1 wherein the liner is nickel, stainless steel, chromium, monel, or an alloy thereof.

21. The terminal unit of claim 1 wherein the metallic electrical connection means is attached to the peripheral edge of the electric current transmission element.

22. The terminal unit of claim 1 wherein the metallic electrical connection means is attached to a portion of the electric current transmission element co-extensive with the electrode component.

23. The terminal unit of claim 1 wherein the sealing means is a peripheral edge having a thickness at least about two times greater than the thickness of the central portion of the electric current transmission element.

24. The terminal unit of claim 1 wherein the sealing means is a peripheral edge not more than about 10 centimeters thick and the central portion of the electric current transmission element is at least about 0.5 centimeters thick.

25. The terminal unit of claim 1 wherein the sealing means is a unitized body with the electric current transmission element.

26. The terminal unit of claim 1 wherein a portion of the sealing means is unitary with the electric current transmission element and a portion of the sealing means is a separate element.

27. The terminal unit of claim 1 wherein the sealing means is a plurality of assembled parts.

28. The terminal unit of claim 1 wherein the sealing means is a window-shaped element and covers the electric current transmission element.

29. The terminal unit of claim 1 wherein the sealing means is a gasket.

30. The terminal unit of claim 1 wherein at least one of the electrode components is gas permeable and contacts a gas chamber positioned between the electric current transmission element and the electrode component.

31. The terminal unit of claim 1 wherein at least one of the electrode component is pressed against or bonded to the ion exchange membrane.

* * * * *

UNITED STATES PATENT AND TRADEMARK OFFICE

CERTIFICATE OF CORRECTION

PATENT NO. : 4,654,136

DATED : March 31, 1987

INVENTOR(S) : Hiep D. Dang, Richard N. Beaver and John R. Pimlott

It is certified that error appears in the above-identified patent and that said Letters Patent is hereby corrected as shown below:

Please insert the following under "References Cited":

| | | | |
|---|---|---|---|
| 4,017,375 | 4/1977 | Pohto | 204/255 |
| 4,116,805 | 9/1978 | Ichisaka et al | 204/290F |
| 4,194,670 | 3/1980 | Ichisaka et al | 228/179 |
| 4,279,731 | 7/1981 | Pellegri | 204/254 |
| 4,339,322 | 7/1982 | Balko et al | 204/255 |
| 4,343,689 | 8/1982 | de Nora et al | 204/253 |

Under "References Cited"; please delete the following patent number:

| | | | |
|---|---|---|---|
| 4,214,969 | 7/1980 | Lawrance | 204/279 |

Col. 13, line 37; change "intended" to --indented--.

Col. 13, line 40; change "linear" to --liner--.

Col. 22, line 12, Claim 13; insert --1-- between "claim" and "wherein".

Col. 24, line 5, Claim 31; change "component" to --components--.

Signed and Sealed this

Thirteenth Day of October, 1987

*Attest:*

DONALD J. QUIGG

*Attesting Officer*

*Commissioner of Patents and Trademarks*